US006948716B2

(12) United States Patent
Drouin

(10) Patent No.: US 6,948,716 B2
(45) Date of Patent: Sep. 27, 2005

(54) WATERSTOP HAVING IMPROVED WATER AND MOISTURE SEALING FEATURES

(76) Inventor: Gérard Drouin, 293 rue du Parc, Pintendre, QC (CA), G6C 1C3

( * ) Notice: Subject to any disclaimer, the term of this patent is extended or adjusted under 35 U.S.C. 154(b) by 118 days.

(21) Appl. No.: 10/378,808

(22) Filed: Mar. 3, 2003

(65) Prior Publication Data

US 2004/0173977 A1 Sep. 9, 2004

(51) Int. Cl.[7] ..... E04B 1/684

(52) U.S. Cl. ..... 277/606; 277/626; 277/921; 52/396.02

(58) Field of Search ..... 277/606, 626, 277/906, 921; 404/64, 65; 52/396.02, 396.03

(56) References Cited

U.S. PATENT DOCUMENTS

| | | | | | |
|---|---|---|---|---|---|
| 2,228,052 | A | * | 1/1941 | Gardner | 52/396.03 |
| 2,901,904 | A | * | 9/1959 | Wey | 52/396.03 |
| 2,961,731 | A | * | 11/1960 | Buzzell et al. | 264/35 |
| 3,411,260 | A | * | 11/1968 | Dill | 52/396.03 |
| 3,884,000 | A | * | 5/1975 | Faleij | 52/127.3 |
| 3,956,557 | A | * | 5/1976 | Hurst | 428/167 |
| 4,041,665 | A | * | 8/1977 | de Munck | 52/396.02 |
| 4,059,935 | A | * | 11/1977 | Faid | 52/396.02 |
| 4,127,350 | A | * | 11/1978 | Weber | 404/65 |
| 4,558,875 | A | * | 12/1985 | Yamaji et al. | 277/312 |
| 4,622,784 | A | * | 11/1986 | Black et al. | 52/2.11 |
| 4,740,404 | A | * | 4/1988 | Otsugu et al. | 428/44 |
| 5,375,386 | A | * | 12/1994 | Goad | 52/396.03 |
| 5,988,648 | A | * | 11/1999 | Schmid | 277/316 |
| 6,151,790 | A | * | 11/2000 | Whitfield | 33/533 |

OTHER PUBLICATIONS

"Canadian General Standard Board" Jul. 1983 p. 5.
"Evolution of Watertight Construction . . . " John H. Scarino p. 51 Int. Concrete Apr. 1981.
NRCA Water Proofing & Dampproofing Manual Dec. 1993.
Canadian Portland (French) pp. 2,3,4.

* cited by examiner

*Primary Examiner*—Alison K. Pickard

(57) ABSTRACT

An improved waterstop having the important added feature of a hydro expansive compound which expands when subjected to water. By expanding, the hydro expansive compound effectively blocks the passage of water that leaks into the gaps created during the shrinkage of the concrete surrounding the improved waterstop. All that is required are narrow strips of judiciously positioned hydro expansive compound at opposite ends of the improved waterstop.

8 Claims, 4 Drawing Sheets

Figure 1:
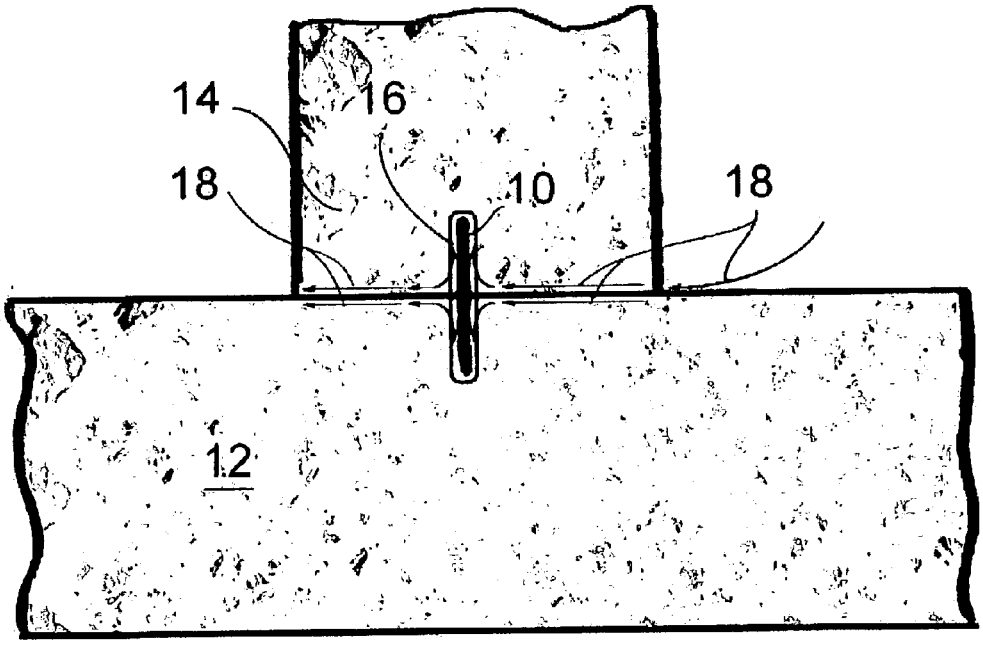

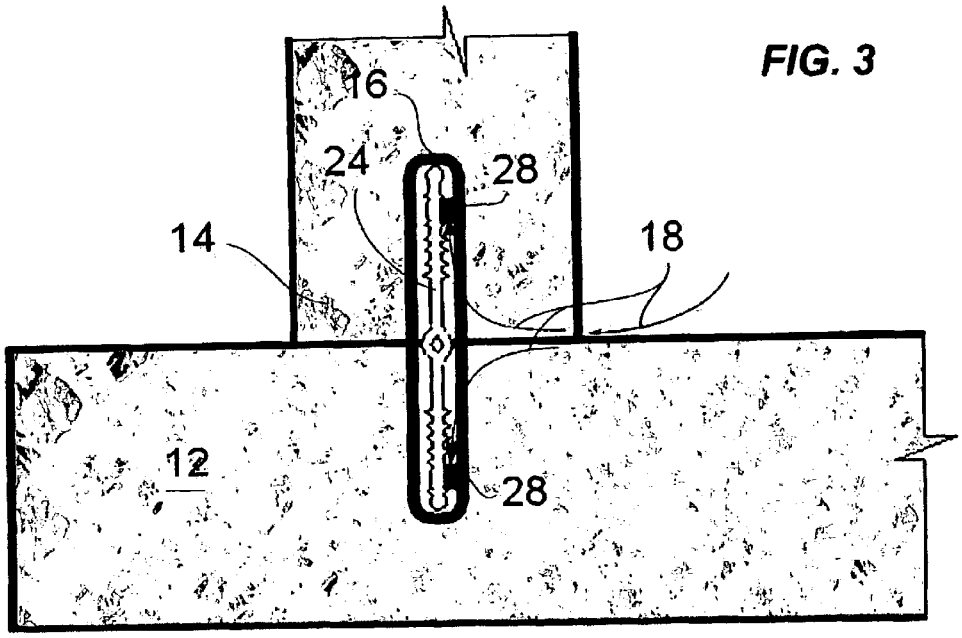
FIG. 3
FIG.5
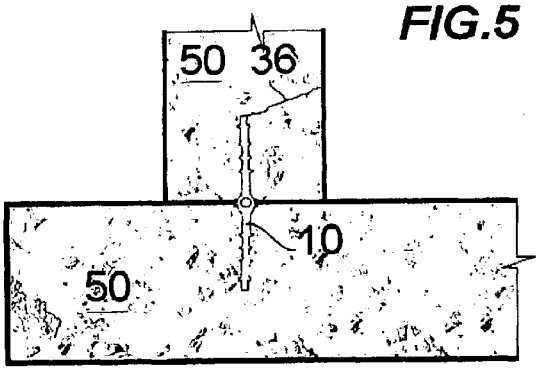
FIG.6
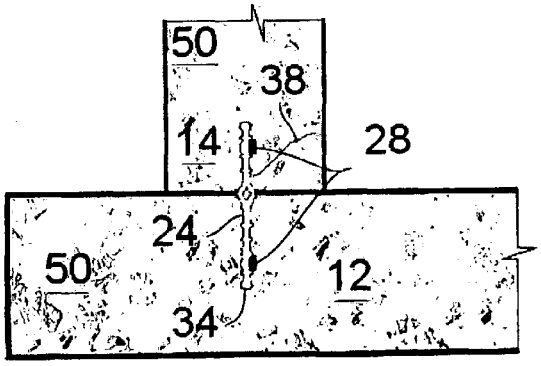

WATERSTOP HAVING IMPROVED WATER AND MOISTURE SEALING FEATURES

BACKGROUND OF THE INVENTION

1. Field of the Invention

This invention relates generally to concrete structures but more particularly to a water sealing element for concrete joints.

2. Background

Preventing the passage of water through concrete joints is essential for liquid-containing or liquid-excluding structures such as foundation walls, tunnels, swimming pools, reservoirs, water and sewage treatment plants, retaining walls, culverts, bridge abutments, cisterns, dams and other such structures.

Building these structures, however, often requires separate concrete pours, that is one pour for the first horizontal element of the structure followed a second pour for the vertical element of the structure and sometimes additional pours are needed just for continuing an extremely long horizontal surface. Waiting for one element of the structure to dry before starting the second pour results in an imperfect mating of the two adjoining elements of the structure since there is no adherence between dry and wet concrete. This imperfect mating plus the normal concrete shrinkage that occurs as concrete dries can create a passage for water.

To prevent this problem, a number of solutions have been developed. The most popular is the use of PVC strips known in the industry as PVC waterstops. These are long strips inserted vertically and halfway into fresh concrete and when the second pour is done, the PVC waterstop is totally immersed into concrete and will act as a dam for water that would normally follow the passage between the two pours.

PVC waterstops currently in use are far from perfect and one of the inconveniences of using them is that since polyvinyl chloride has zero adhesion with concrete, the smallest shrinkage of concrete, which is normal during the curing process. Even for walls 150 mm thick, it can take 850 days for moisture to drop to below 50% at the center, as is described in an information brochure published by Portland cement. As moisture level drops, shrinkage occurs which creates a gap between the concrete and the PVC waterstop since PVC doesn't adhere to concrete. This is when a passage for water is formed.

More and more contractors and consultants refuse to use or recommend the use PVC waterstops and do not want to be responsible for any leaks that should occur if PVC waterstops are used.

A newer method to seal concrete joints involvesd the use of a hydro expansive compound, the most popular being EPDM (Ethylene Propylene Diene Monomer) combined with an hydro expansive resin, but other such compounds can offer similar properties. The hydro expansive compound is cut into long strips that are slightly narrower than the width the second pour will be and is laid flat on top of the first pour, after it has dried and just before the second pour. After both pours have cured and shrinkage has created a passage for water, the hydro expansive compound inflates as it gets in contact with water. By inflating, it is able to block the passage of water.

The use of the hydro expansive compound in this fashion is not without flaws however. The curing process of concrete is quite complex and must be understood in order to realize why this approach is flawed:

Due to segregation and bleeding, the uppermost layer of cured concrete is more fragile and brittle, this layer is about 0–5 mm in thickness and is characterized by a white powder on the surface. It is necessary to remove this fine layer by using various abrading means such as sandblasting or high pressure water. This has to be done before laying the hydro expansive compound. This can fix half of the problem but this bleeding and segregation can also occur at the bottom of the second pour for which there is no way it can be fixed. Moreover, another factor to consider in making separate pours is that if the first pour is unusually dry, it will absorb moisture from the second pour and upset the water to concrete ratio and if the first pour is too humid, again it can upset the ratio of the second pour. This also affects a layer about 0–5 mm in thickness at the junction between the two pours where the concrete can be more fragile. Also, in the case of a vertical structure, such as a wall, the higher the wall is, the harder it is to get a good compacting of the concrete by way of a vibrator. This zone of higher risk of porosity is situated at between 0–20 mm in height starting from the joint between the two pours.

Since the hydro expansive compound lays flat, it cannot handle the problem of difficult compacting in the 0–20 mm zone and although the hydro expansive compound can stop water at the joint, another passage for water can be created just above it, rendering the hydro expansive compound less efficient.

Because both the PVC waterstops and the hydro expansive compound are deficient, there is a need for a better waterstop.

SUMMARY OF THE INVENTION

It is a first object of this invention to provide for an efficient waterstop which can maintain its waterstopping characteristics even after the concrete has shrunk and separated from it and has created a preferential passage for water.

It is a second object of this invention to provide for an efficient waterstop which can provide waterstopping capabilities beyond the zone of higher risk of porosity which is situated at 20 mm and below.

In order to do so, the present invention consists of an improved waterstop configured and sized much like existing PVC waterstops but with the important added feature of an hydro expansive compound. Current technology allows for up to 600% expansion in volume for hydro expansive compound when subjected to water. By expanding, the hydro expansive compound effectively blocks the passage of water that leaks into the gaps created during the shrinkage of the concrete surrounding the improved waterstop. All that is required are two narrow strips of judiciously positioned hydro expansive compound at opposite ends of the improved waterstop.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

FIG. 1 Side elevation of a waterstop from the prior art in context.

Figure 2:
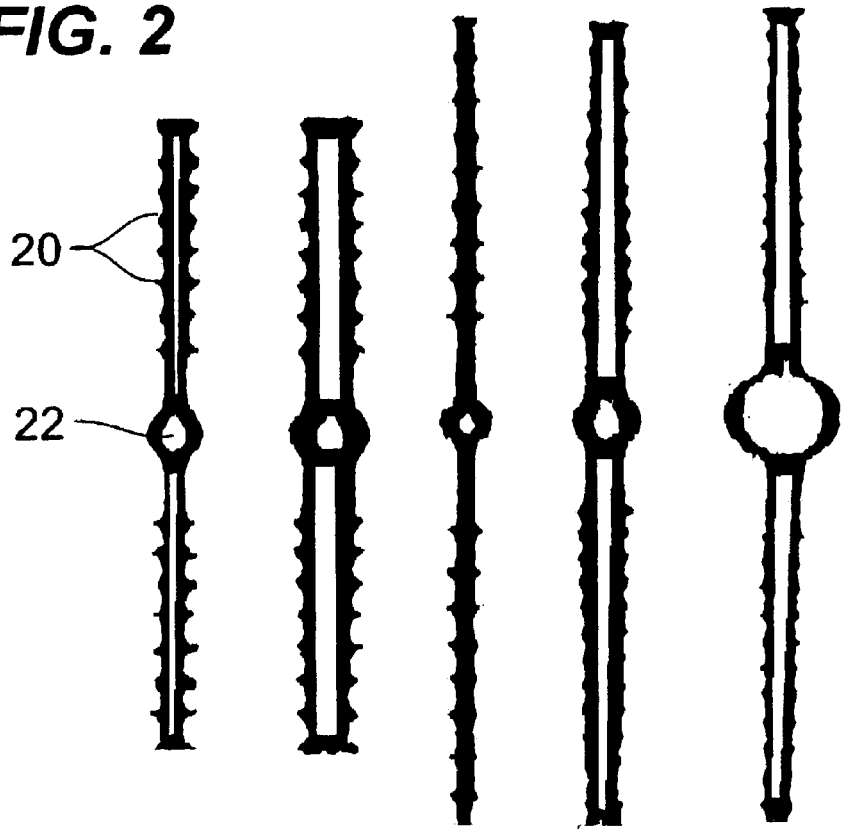

FIG. 2 Side elevation of various models of prior art waterstops.

FIG. 3 Side elevation of improved waterstop in context.

Figure 4:
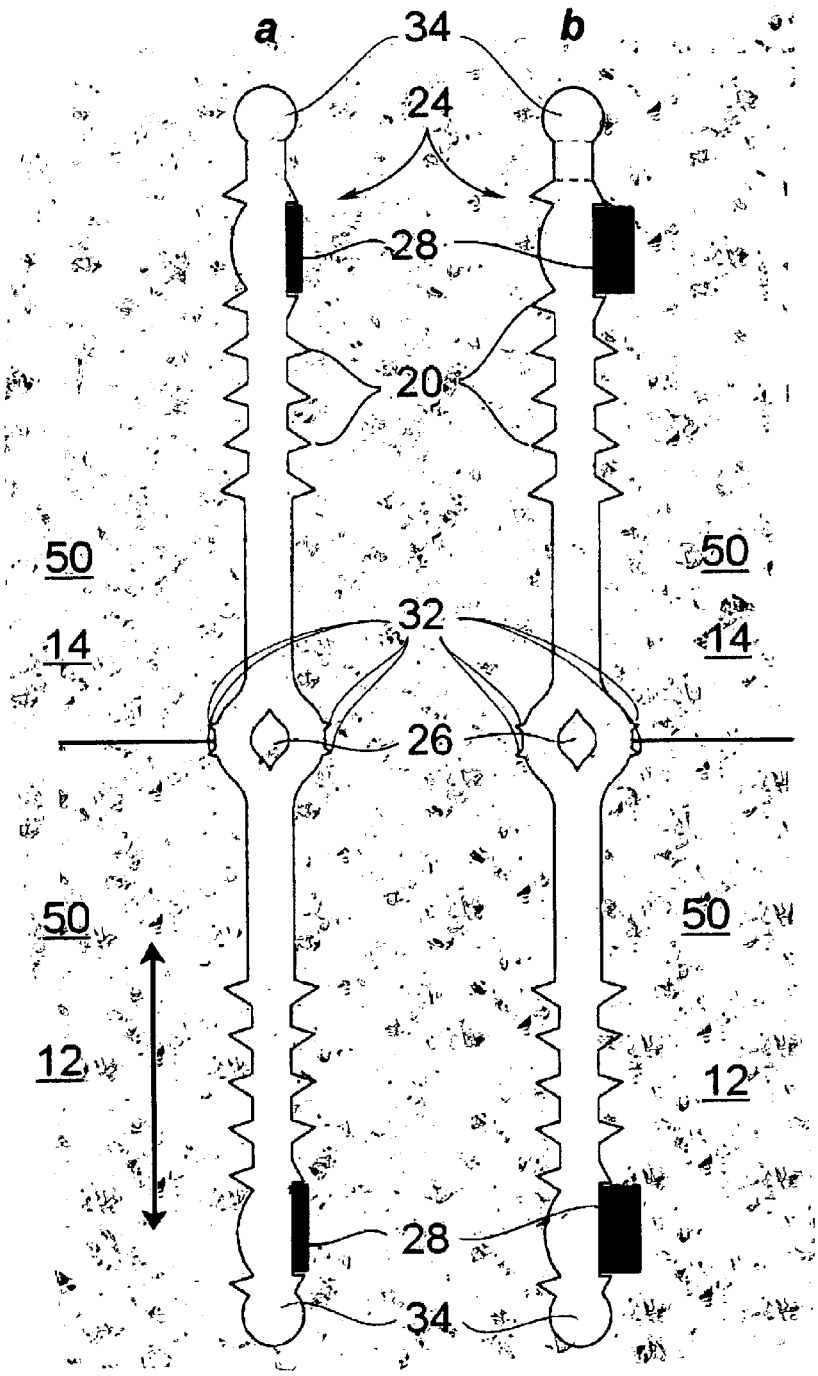

FIG. 4*a* Side elevation of an improved waterstop with the expansion strip dry.

FIG. 4*b* Side elevation of an improved waterstop with the expansion strip wet.

FIG. 5 Side elevation of waterstop from the prior and how it can cause a fissure.

FIG. 6 Side elevation of fictional waterstop and how a bad position of the hydro expansive compound could cause a fissure.

Figure 7:
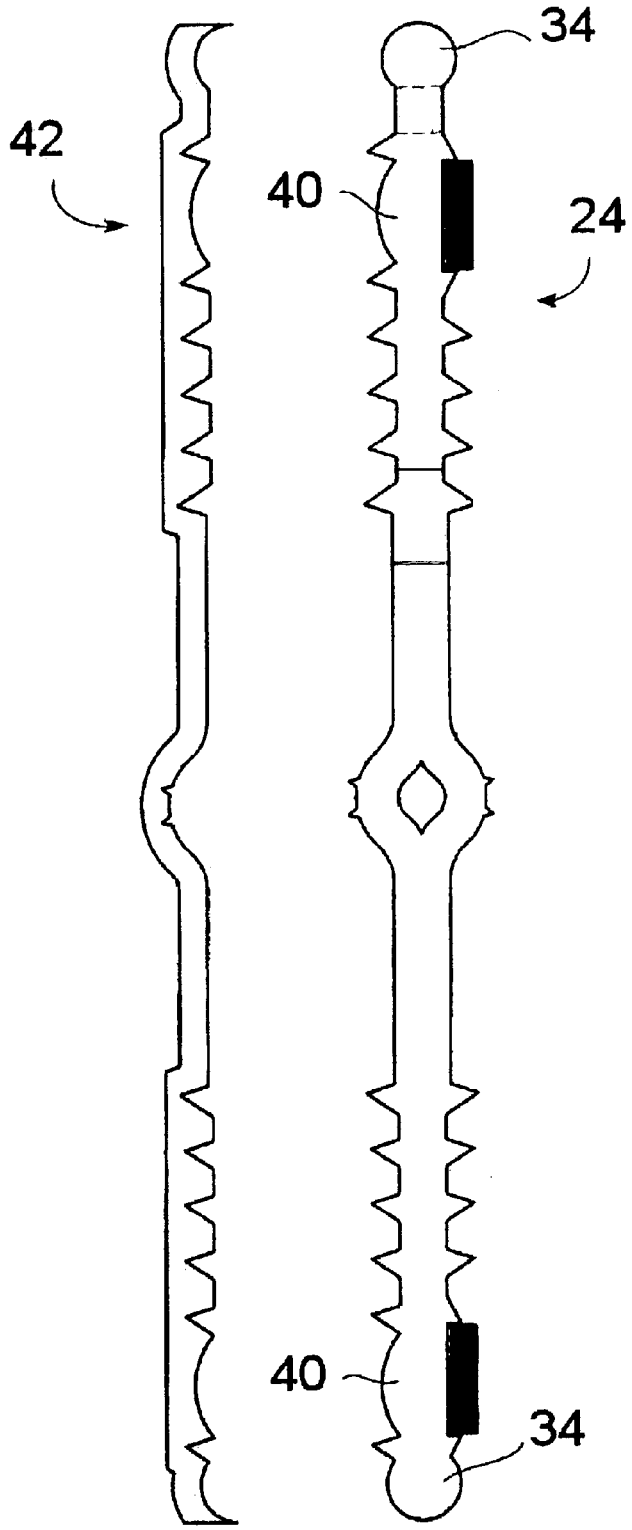

FIG. 7 An improved waterstop with its joining element.

DETAILED DESCRIPTION OF THE PREFERRED EMBODIMENT

More specifically in FIG. 1, a waterstop of the prior art (10) is a vertical strip rather thin, ribbon like, and is inserted so that it overlaps both the first pour (12) and the second pour (14). The waterstop of the prior art (10) suffers from the fact that PVC doesn't adhere to concrete (50) and that over time, such as with twenty years of aging, there is a loss in plasticizer as well as a migration and segregation of internal components and shrinkage of both the PVC waterstop and the concrete (50). This shrinkage creates an empty space (16) which results in water (18) infiltrating alongside the waterstop of the prior art (10) which renders it useless.

More specifically in FIG. 2, there are many variations in the design of waterstops of the prior art (10). They are all thin compared to their height and have small ridges (20) protruding from both sides along the height of the waterstop (10), also, all have a round hollow core (22) halfway across the height of the waterstop (10).

More specifically in FIG. 3, an improved waterstop (24), appearing at first glance to be shaped like the waterstop of the prior art (10), that is ribbon like, will not allow water to infiltrate because of an expansion strip (28) which fills the empty space (16). This expansion strip (28) can be positioned by two different methods, either it is bonded to the improved waterstop (24) by use of an adhesive or it is bonded by the process of co-extrusion where the hydro expansive compound of the expansion strip (28) is conjoined with the rest of the improved waterstop (24) while both are still in a soft state. Although the expansion strips (28) appear as rectangles in the accompanying drawings, they can be shaped differently such as with rounded or beveled edges.

More specifically in FIG. 4*a,* the improved waterstop (24) has ribs (30) extending perpendicularly from both of its sides and has an oval core (26) situated halfway along its heigth. In this figure, the expansion strip (28) is dry. When first installed, it is important that the improved waterstop (24) be inserted in the fresh concrete (50) halfway between two pairs of little horns (32) situated proximal and on each side of the oval core (26). Improper positioning of the improved waterstop (24) can void warranty. Also, care must be taken with the kind of concrete (50) used, it should be 25 MPA in density and use a 24.5 mm diameter head on a vibrator operating at 200 Hz and positioned vertically no closer than 15 cm from the improved waterstop (24), otherwise, an improper vibrator can cause a resonance again the improved waterstop (24) which could result in porosity around the improved waterstop (24). When properly done, air bubbles are removed from the concrete (50) and a proper curing can occur.

More specifically in FIG. 4*b,* the same improved waterstop (24) but with its expansion strip (28) wet. The volume of the expansion strip (28) increases so that it can block any gaps between the improved waterstop (24) and the concrete pours (12, 14, of FIG. 2).

Seasonal variations can also affect concrete (50). It is well known that cold temperatures can shrink many materials, including concrete (50) and PVC. Counterintuitively, water flow is generally stopped in cold temperature even with waterstop of the prior art (10) since, as is the case with the improved waterstop (24), the traction of concrete (50) along the height of the improved waterstop (24) stretches it somewhat. The ribs (30) act as anchors and actually stretch the improved waterstop (24) so that the ribs (30), or the small ridges (20) as for the waterstop of the prior art (10), actually make contact with the concrete (50) and can stop or slow down the infiltration of water. The stretching of the improved waterstop (24) is aided by the oval core (26) which flattens as it stretches. The oval shape which is longer in the direction of stretching favors stretching in that direction, more so than the round hollow cores (22) of waterstops of the prior art (10).

During warm periods, the concrete (50) and improved waterstop (24) expand and release tension and water can circulate until the expansion strip (28) stops it. Because the expansion strip (28) absorbs water slowly and therefore expands slowly, it doesn't have much time for expansion during the curing process. However, once the concrete (50) has dried, cured and has begun to shrink and water starts leaking, it may allow minute amounts of water to pass as it begins to expand but after some time, water will be stopped completely. Also, the expansion strip (28) will also retain their expansion for a long time as the moisture inside concrete (50) will remain for a long time. The expansion strip (28) will practically never have time to fully shrink but will rather stay relatively expanded so that when there is a second passage of water, it will be more quickly blocked. Typically the hydro expansive compound will take 24 hours to expand 110–350% in volume, 72 hours for 230–550% and after 28 days, 600%. Therefore, all depending upon the void that needs to be filled, and the flow rate, it will take more or less time to block the passage of water.

More specifically in FIG. 5, each extremity of the improved waterstop (24) is terminated by a circular bulb (34) as seen more clearly in FIGS. 4A*b,* 6 and 7, the roundness, as opposed to a square edged end as found in the waterstops of the prior art (10) reduces the incidence of the creation of a fissure (36) at this location, as described in publication <<Concrete International, April 1991>> (in reference), this fissure is caused when a force is exerted on a wall before it had time to cure, i.e. 7 days after pouring concrete has generally reached about 70% of its MPA and is therefore still sensitive to stress. Should pressure, tension or stress be applied to the concrete prior to 7 days, the probability of having a fissure (36) at this location is much lower when using of a circular bulb (34) as opposed to a square edged end as with a waterstop of the prior art (10).

More specifically in FIG. 6, another way of limiting the creation of a $2^{nd}$ set of fissures (38) is by the judicious positioning of the expansion strip (28). Since a pressure of less than 60 lbs/square inch can be created against the concrete (50) by the expansion of the expansion strip (28), this pressure can create a $2^{nd}$ set of fissures (38) if the expansion strip (28) would be placed too close to the junction between the first pour (12) and the second pour (14), as is seen with a fictional waterstop (not really the improved waterstop (24)) having too short a distance to the joint. Therefore, a minimal distance is recommended which has to be above the 20 mm zone of higher risk of porosity previously described in the background of the invention. Ideally it should be between 38 mm and 59 mm above and below the oval core (26). Also, the improved waterstop (24) should have its expansion strip (28) no closer than 70 mm from the edge of the wall it is expanding toward. The range in distance of the expansion strip (28) is in relation with the overall height of the improved waterstops (24) which varies between 110 mm and 178 mm. The thickness of the improved waterstops (24) is also proportional, varying between 4 mm and 6 mm and finally, the thickness of the expansion strip (28) also varies between 2 mm to 6 mm when dry. The larger size improved waterstops (24) is for use where water pressure is higher. The variety in choices allows for the use of the proper improved waterstop (24) for a particular need.

More specifically in FIG. 7, to counteract the less than 60 pound/sq in. pressure, the opposite side (40) of the expandable strip (28) is convex to distribute the load over a larger area, it also acts as additional support to eliminate the risk of deformation of the improved waterstop (24) and, finaly, also serves as additional anchoring means, like the ribs (30) descibed above.

When a length of improved waterstop (24) comes to an end, a second strip of improved waterstop (24) begins and a joining element (42) is mated to the two ends of the improved waterstop (24) by using a fast drying adhesive. The joining element (42) is configured and sized to complement the shape of the improved waterstops (24) in order to insure proper bonding. The fact that the joining element (42) overlaps the junction point between the two lengths of improved waterstops (24) provides an excellent protection against the passage of water even if there is a gap at the junction. The junction point of waterstops of the prior art (10) is simply done by heat welding the two ends of the waterstops (10) and does not benefit from the added sealing capabilities of an overlapping joining element (42).

What is claimed is:

1. An improved waterstop to stop water from infiltrating, shaped like a ribbon having a height and two sides and comprising:

ribs protruding perpendicularly from both its sides;

expansion strips made of an hydro expansive compound;

an oval core situated halfway along its height;

two pairs of little horns situated proximal and on either sides of the oval core;

each extremity along the height is terminated by a circular bulb; and, directly opposite each expansion strip, on the other side is a small convex shape protruding.

2. An improved waterstop to stop water from infiltrating as in claim 1 whereas:

the expansion strips are positioned on the same side and at a predetermined distance from the oval core.

3. An improved waterstop to stop water from infiltrating as in claim 1 whereas:

a joining element, configured and sized to complement the shape of the improved waterstops creates a junction between two ends of improved waterstops by overlapping both ends.

4. An improved waterstop to stop water from infiltrating as in claim 1 whereas:

the distance from the expansion strip to the oval core is set between 38 mm and 59 mm;

the overall height of the improved waterstop is set between 110 mm and 178 mm;

the thickness of the improved waterstop is set between 4 mm and 6 mm;

the thickness of the expansion strip is set between 2 mm to 6 mm when dry.

5. An improved waterstop to stop water from infiltrating as in claim 4 whereas:

the expansion strip is set no closer than 70 mm from the edge of the wall.

6. An improved waterstop to stop water from infiltrating as described in claim 1 manufactured using the following method:

the expansion strip is bonded by the process of co-extrusion where the said expansion strip is conjoined with the rest of the improved waterstop while both are still in a soft state.

7. An improved waterstop to stop water from infiltrating as described in claim 1 having the following method of intallation:

the improved waterstop is inserted in fresh concrete halfway between the two pairs of little horns situated proximal and on each side of the oval core;

concrete should be 25 MPA in density and use a 24.5 mm diameter head on a vibrator operating at 200 Hz and positioned vertically no closer than 15 cm from the said improved waterstop.

8. An improved waterstop to stop water from infiltrating, shaped like a ribbon having a height and two sides and comprising ribs protruding perpendicularly from both its sides, expansion strips made of an hydro expansive compound, an oval core situated halfway along its height, two pairs of little horns situated proximal and on either sides of the oval core, and each extremity along the height is terminated by a circular bulb, said waterstop having the following method of installation:

inserting the waterstop in fresh concrete halfway between the two pairs of little horns situated proximal and on each side of the oval core, wherein the concrete density is 25 MPA, and using a 24.5 mm diameter head on a vibrator operating at 200 Hz and positioned vertically no closer than 15 cm from the waterstop.

* * * * *